US012359335B2

(12) United States Patent
Muratori

(10) Patent No.: US 12,359,335 B2
(45) Date of Patent: Jul. 15, 2025

(54) METHOD OF DECORATING PVD COATED SURFACES AND DECORATED SURFACES OBTAINED

(71) Applicant: METALY S.R.L., Formigine (IT)

(72) Inventor: Stefano Muratori, Formigine (IT)

( * ) Notice: Subject to any disclaimer, the term of this patent is extended or adjusted under 35 U.S.C. 154(b) by 0 days.

(21) Appl. No.: 17/929,317

(22) Filed: Sep. 2, 2022

(65) Prior Publication Data

US 2023/0071739 A1 Mar. 9, 2023

(30) Foreign Application Priority Data

Sep. 2, 2021 (IT) ..... 102021000022757

(51) Int. Cl.
*C23C 28/00* (2006.01)
*C25D 11/02* (2006.01)

(52) U.S. Cl.
CPC ..... *C25D 11/022* (2013.01); *C23C 28/32* (2013.01); *C23C 28/345* (2013.01); *C25D 11/024* (2013.01); *Y10T 428/12583* (2015.01)

(58) Field of Classification Search
None
See application file for complete search history.

(56) References Cited

U.S. PATENT DOCUMENTS

2009/0218233 A1* 9/2009 Fredenberg ..... C25D 7/126 205/640
2018/0298499 A1* 10/2018 Chang ..... C23C 24/106
2020/0277707 A1* 9/2020 Twardy ..... C25D 11/14
2020/0347492 A1* 11/2020 Tryon ..... B32B 15/043

* cited by examiner

*Primary Examiner* — Xiaobei Wang
(74) *Attorney, Agent, or Firm* — Patshegen IP; Moshe Pinchas

(57) ABSTRACT

A method for decorating metallic or non-metallic surfaces treated with Physical Void Deposition, PVD, comprising: an electrochemical activation action of the decoration by means of an electrical circuit with electrodes in electrical contact and for at least one thereof with the mediation of an electrolytic solution towards a surface being treated; an electrically conductive surface facing one of said electrodes to form said surface being treated; at least one masking resistant to the electrochemical activation action of the decoration and interposed between the facing electrode and the surface being treated; and has the electrochemical action of activating the decoration of the treated surface occurs by electrochemical oxidation of the metallic oxide layer normally present on the electrically conductive surface whether it is placed below the PVD coating layer, i.e., performed before such PVD coating, or such electrochemical oxidation action is performed above said vacuum metallic coating, electrically conductive PVD layer; the electrochemical oxidation acts with the surface of the treated metal, its natural oxide, or the PVD coating itself, i.e., on the oxides, carbides, nitrides forming it, without any removal of metallic material but with the aesthetic modification of the treated surface in the shape determined by the aforesaid masking.

3 Claims, 4 Drawing Sheets

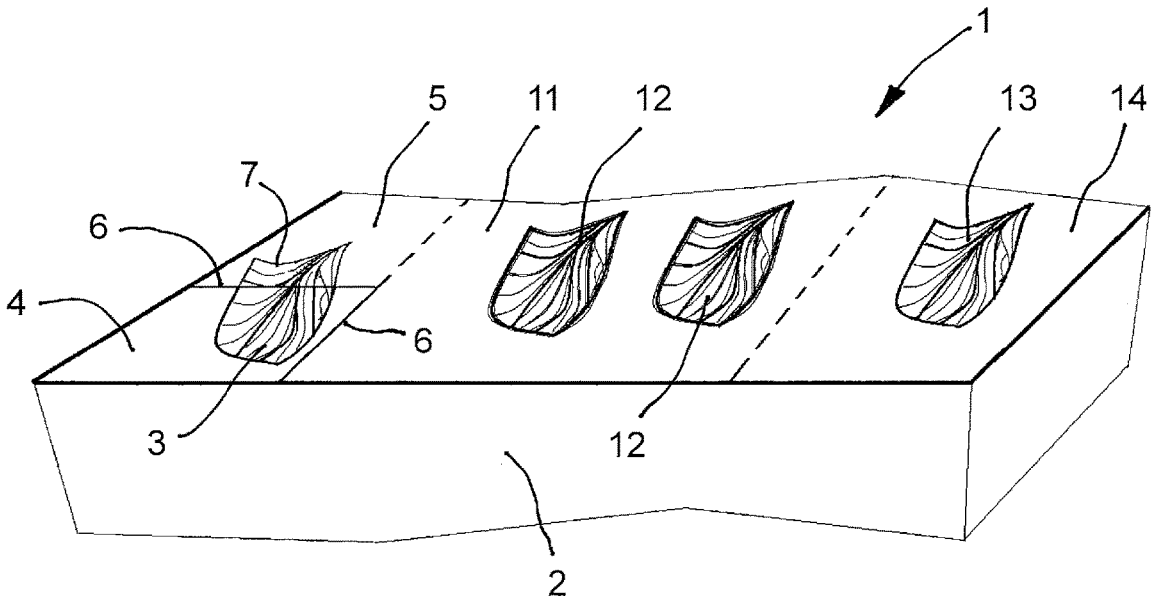
Fig. 1
Fig. 2
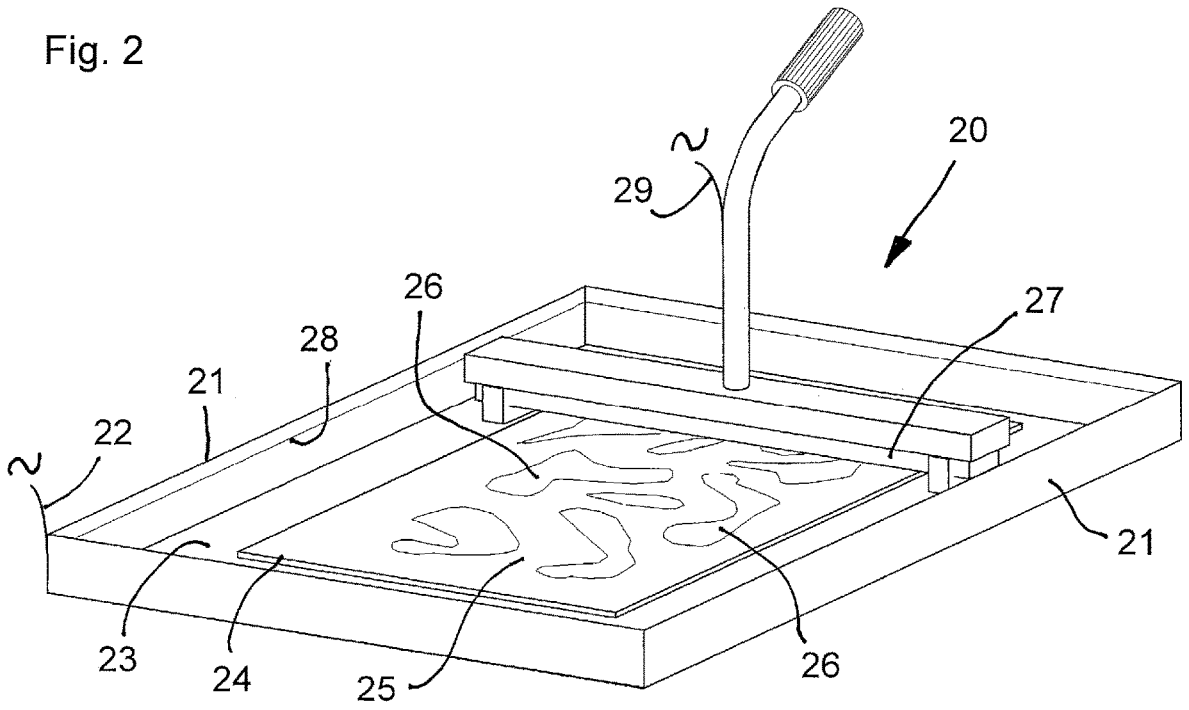

METHOD OF DECORATING PVD COATED SURFACES AND DECORATED SURFACES OBTAINED

FIELD OF APPLICATION

The present disclosure relates to the application method of a decoration to surfaces which are treated with the deposition of metals in atomic form by vacuum, better known by the acronym PVD. That is, the surfaces which undergo the treatment with the PVD method are addressed in this disclosure in such a way as to highlight a surface decoration of the PVD deposit, whether the decoration is made on a lower metallic surface before the PVD treatment, or whether the decoration is made after such treatment; the surfaces decorated with the aforesaid method are also comprised.

BACKGROUND ART

The state of the art comprises the treatment method of metallic and even non-metallic surfaces with the physical deposit of oxides, carbides, metal nitrides, vaporized by the vacuum action of a specific starting material for each combination of oxides, carbides, metal nitrides to be deposited, known as Physical Vapor Deposition, i.e., with the acronym PVD. Moreover, it is known that the PVD deposit layer on the treated surface is of the order of a few hundred nanometres and, therefore, said layer covers the surface of the oxide but does not cover the view of the treated surface, the roughnesses remaining highlighted, i.e., at the same time this metallic layer, which constitutes the deposit, is intimately combined to the surface on which it is applied without leaving thicknesses if not within 1000 nanometres of such a layer. In fact, the appearance of the surface after the PVD deposit corresponds to the brightness or opacity of the surface before the deposit: the thickness of the deposit is less than 1 micrometre, i.e., it does not influence the light reflection of the original surface.

Moreover, very different methods are known in the manufacture of PVD coatings, but they are essentially divided into decorative PVD coatings, with a deposit thickness contained within 1,000 nanometres, and functional/technical PVD coatings with much greater thicknesses, i.e., from 5,000 to 10,000 nanometres.

Furthermore, it is known to decorate metallic surfaces such as plates, foils, sheets and metallic mesh and fabrics with an electrolytic action which is intended to decorate with a limited action which affects the outer metallic surface on which the decoration it is applied, i.e., only the thickness of the oxide naturally present in all metallic surfaces, for example in stainless steel of the order of 100 to 200 nanometres, for other metals the thickness of the natural oxide does not exceed 1 micrometre.

Furthermore, it is known in the art to perform treatments on metallic PVD layers by masking, to define a specific conformation of the treated surface, and subsequently by anodic deposition of metals which go to fill the voids obtained with the previous surface attack to create layers with specific conformation. These treatment methods identify the use of surface treatments also with PVD, but the application of engravings and subsequent metallic fillings does not allow to create a surface with a decorative effect, but only surfaces with a technical effect, generally multilayer. A description of these methods is present in CN 1570221 A, in which the engraving of the chromium metallic layer appears using direct current applied to the metallic layer to be engraved and to the engraving solution.

A further description of an engraving and filling method of metallic layers also in PVD is present in WO 2007/058603 A1 in which by means of an anodic electrodeposition, structures with layers of superimposed metallic materials are manufactured: this is made possible by the anodic deposition of a metallic material connected with the cathode, within the compartments of a masking conformation of the metallic surface in previously performed treatments, so as to manufacture superimposed layers with various conformation and obtain the multilayer metallic material, i.e., a technical coating.

It should be noted that in the aforesaid documents the metallic engraving by electrolytic removal and the deposition of metals with the anodic method is applied, i.e., very well known in the art and it does not achieve any decorative effect, but meets structural technical requirements to define electrical paths in the multilayer material thus obtained. Furthermore, the multilayer material obtained does not support the bending of the metallic surface on which it is made, instead the decoration sought by the present invention aims to obtain a bendable surface without mechanical damage or cracking, while maintaining the bent surface with the surface finish identical to the state before bending.

The method and apparatus of applying the selective electrochemical decoration treatment, by masking the treated surface, on a planar surface, whether it is a flat metallic plate, a flexible metallic tape, a metallic fabric or mesh is known in the art; obviously the decoration treatment only concerns the outer part of the covering metallic oxide and not its thickness. The electrochemical decoration treatment acts on the natural oxide of the treated metal, which is notoriously of the order of 1 micrometre, modifying it only in its outermost part and highlighting the areas on the outer layer thereof for a hundred nanometres.

Therefore, the use of aesthetically rendering metallic surfaces, generally used in outdoor furniture on buildings or constructions or even indoor furniture, is already known, but the search to improve the decoration of the same surfaces requires the identification of new decoration methods which are also applicable for the limitations of the usual treatments known for decades with galvanic baths and no longer allowed due to the environmental pollution they generate.

In fact, the main limit of the prior solutions described in the prior art lies in the low decorative variability obtainable with the application of a PVD coating to the metallic and non-metallic surfaces and the possible known decorative variants. The decoration is limited to creating specific homogeneous colours linked to the metallic material (oxides, carbides, nitrides or a combination of oxides, carbides, nitrides) deposited on the treated surface. It is known to use zirconium, chromium, titanium, titanium-aluminium or even aluminium-titanium and aluminium-chromium-based deposits using technical nitrogen, acetylene and methane gases. The main known decorative variant for PVD applications is colour which maintains gloss or opacity, this depending on the surface finish of the base surface on which the PVD treatment is applied. The colour obtained depends on the oxides, nitride carbides of the metals or their combination which is deposited.

Moreover, a PVD coating has considerable advantages with respect to the base metallic or non-metallic surface and also with respect to the known surface galvanic treatments, such as galvanization, chromium plating and nickel plating; in fact, PVD coating has high surface hardness, high corrosion resistance, resistance to salt spray without surface alteration, scratch and abrasion resistance, resistant to solvents, acids or alkalis and household anti-limescale products, as well as being unalterable with prolonged UV light exposure.

Furthermore, the application of the electrochemical decoration mentioned on a metallic surface, if it makes the surface decorated, does not further protect it from the chemical actions of mechanical attack or abrasion as occurs with the application of a PVD coating; moreover, the current limited decorative action of PVD limits the applicability thereof to the field of outdoor or indoor furniture, while the known metallic and non-metallic surfaces of outdoor furnishings on buildings or constructions have limited protection from abrasive and corrosive attacks and alterability with UV light; furthermore, also in indoor furniture with low resistance to scratching and abrasion, as well as resistance to solvents, acids or alkalis. Therefore, from the above a limit of the prior art is clear in the creation of metallic and non-metallic surfaces for outdoor or indoor furnishings which can have the resistance features typical of PVD coating and also have a marked decorative appearance, obtained with electrochemical decoration, pleasant and attractive both for a domestic user, in the coating of furniture, and for a public user in the coating and protection of surfaces exposed to the elements.

This state of the art is subject to considerable refinements related to the possibility of creating a method for decorating surfaces treated with PVD, which overcomes the aforesaid limits of the prior art, making it possible to protect the metallic surface obtained with the resistance features typical of a PVD coating, but which also creates a decorated and improved exposed surface, against the aforesaid outdoor surface attacks, with respect to the simple known electrochemical decoration treatment.

Therefore, the technical problem underlying the present invention is to obtain an application method of the electrochemical decoration of metallic and non-metallic surfaces provided with a Physical Vapor Deposition coating, i.e., in PVD which allows to make decorative graphic shapes which were not previously achievable.

An inherent object of the previous technical problem is to overcome the application limitations of electrochemical decoration on metallic and non-metallic surfaces even in the presence of decorated layers less than a micrometre such as the PVD coating, i.e., to achieve the electrochemical decoration application methods which maintains the features of the PVD applied to the surfaces, both in the application before PVD and in the application on the PVD itself.

A further and not least object of the present invention is to create a decorated metallic surface which in addition to having all the positive features of resistance to external actions of a PVD coating, also has a pleasant and attractive decorative appearance obtained by enhancing the decorations and maintaining the protection features of the PVD coating on the treated surface.

Moreover, a further aspect of the technical problem addressed concerns the application on non-metallic surfaces made treatable with the electrochemical decoration, i.e., to create the decoration of the PVD coating itself, without interfering with the specific properties of the PVD coating itself, applied to a non-metallic and therefore non-electroconductive surface.

SUMMARY OF THE INVENTION

This problem is solved, according to the present invention, by a decoration method of metallic or non-metallic surfaces treated with Physical Vapor Deposition, PVD, comprising:

an electrochemical activation action of the decoration by means of an electrical circuit with electrodes in electrical contact and for at least one thereof with the mediation of an electrolytic solution towards a surface being treated;

an electrically conductive surface facing one of said electrodes forming said surface being treated;

at least one masking resistant to the electrochemical activation action of the decoration and interposed between the facing electrode and the surface being treated;

characterized in that the electrochemical activation action of the decoration of the treated surface occurs by electrochemical oxidation of the metallic oxide layer normally present on the electrically conductive surface, whether it is placed below the PVD coating layer, i.e., carried out before such PVD coating, or such electrochemical oxidation action is carried out on said vacuum metallic coating, electrically conductive PVD layer;

the electrochemical oxidation acts with the treated metallic surface, its natural oxide, or the PVD coating itself, i.e., on the oxides, carbides, nitrides forming it, without any removal of metallic material but with the aesthetic modification of the treated surface in the shape determined by the aforesaid masking.

In a further application form, the decoration with a graphic shape on the treated electrically conductive surface is performed by electrochemical oxidation and subsequently said decorated surface is covered with decorative PVD coating.

Furthermore, in a perfected application form in which the electrically conductive surface treated with the decoration and coated with a PVD coating is in turn treated with a decoration by electrochemical oxidation directly on the decorative PVD coating layer, forming a repeated graphic shape and combined with the original graphic shape.

Moreover, in a further embodiment variant, the decoration made on the PVD coating has a graphic shape associated with the first decoration creation previously made on the electrically conductive surface below the decorative PVD coating and has a conformation such as to make a three-dimensional visual effect for the user of the final decoration.

Furthermore, in a specific perfected embodiment, the treated surface in conductive or non-conductive material and continuous or even non-continuous conformation with a metallic vacuum coating, decorative or even functional/technical PVD coating, electric conductor on which the decoration is made with a graphic shape obtained directly by electrochemical oxidation with masking on such PVD coating.

Furthermore, in a further advantageous application form, the electrochemical action applied on the PVD coating generates shimmering and iridescent oxides in the decoration obtained.

Moreover, a specific embodiment, obtained with the method described above, are surfaces decorated with electrically conductive materials with continuous or non-continuous conformation in which the decoration has shimmering and iridescent colours.

Furthermore, in an embodiment variant, they are surfaces decorated with electrically conductive materials with continuous or non-continuous conformation, in which with the application of the metallic coating under vacuum, decorative PVD, such surfaces have high surface hardness, high corrosion resistance, resistance to salt spray exposure without surface alteration, scratch and abrasion resistance, unattackable by solvents, acids or alkalis and anti-limescale products for domestic use, as well as being unalterable to prolonged UV light exposure.

Moreover, in an embodiment variant: they are surfaces decorated with non-electrically conductive materials with continuous conformation, in which the electrically conductive PVD coating has the decoration by electrochemical oxidation obtained on the PVD coating with shimmering and iridescent visual effects.

Lastly, in combination with the previous embodiment variants, they are surfaces decorated with electrically conductive materials with continuous or discontinuous conformation and treated with the decoration method by superimposition of the graphic shapes, in which the superimposition of the decorations creates a three-dimensional graphic shape to the user's view.

Further features and the advantages of the present invention, in obtaining a method for decorating metallic or non-metallic surfaces treated with PVD, will be manifest by the following description of decoration method applications and the creation of decorated surfaces, given by way of non-limiting example, with reference to the four attached drawing tables.

BRIEF DESCRIPTION OF THE DRAWINGS

FIG. 1 depicts a schematic perspective view of a general metallic surface section on which decorations according to the present disclosure are made; the depicted decorations are made with the same masking for the electrochemical action on the metal of such surface and with the application on such surface of a general PVD coating after and before and after the application of such PVD coating.

FIG. 2 depicts a schematic perspective view of a device for decorating metallic surfaces with electrochemical action; it can also be used on metallic surfaces already treated with a PVD coating.

DETAILED DESCRIPTION OF SOME ACTUATION MODES

Figure 3:
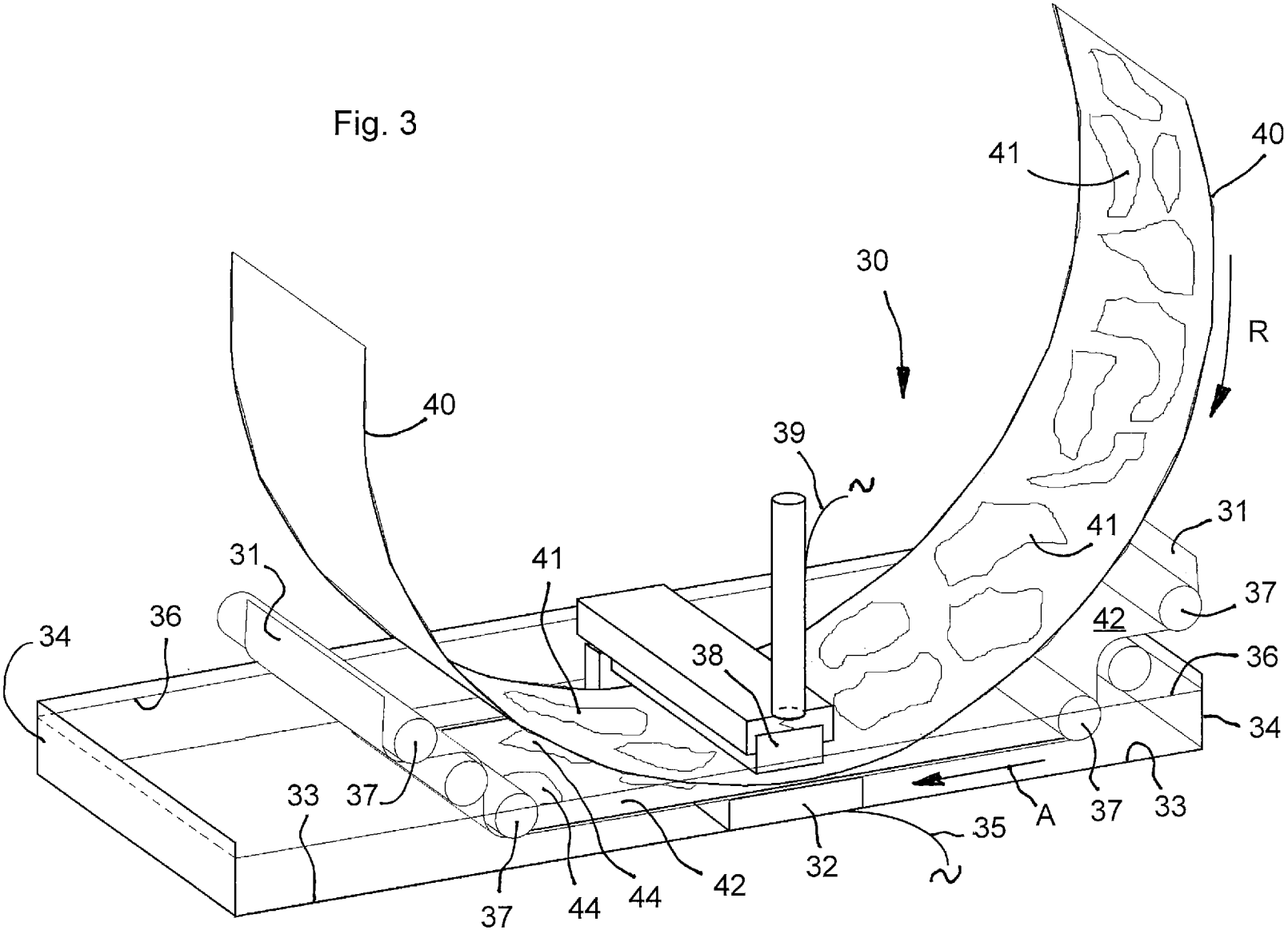
FIG. 3 depicts a schematic perspective and sectional view of a device for decorating flexible metallic surfaces with electrochemical action; it can also be used on metallic surfaces already treated with a PVD coating.

FIG. 1 shows different decorating methods of a surface covered by a PVD coating. The surface 1 of the sheet or plate 2, generally metallic, is decorated with similar graphic shapes of which the graphic shape 3 is directly marked on the outer surface 4 of the sheet or plate 2; the electrochemical decoration action is formed on the outer surface 4 showing the graphic shape 3 clearly visible thereon, as formation/modification of the specific natural oxide of the surface metal of the sheet or plate 2 after the electrochemical decoration action. In zone 5 of the sheet or plate, a metallic PVD coating deposit is applied, limited to the lines 6 which are only part of the graphic shape 3. The PVD coating, above the graphic shape 3, blends the lines giving a different aesthetic effect in part 7 of such graphic shape 3 covered by the PVD coating. Furthermore, again in FIG. 1, the central zone 11 is decorated with graphic shapes 12 which have been made with the same masking as the graphic shape 3, above, but which have been further decorated with the same graphic shape or a similar graphic shape to simulate a wider edging of the original graphic shape 3, performing the electrochemical action directly on the surface of the PVD coating, which was obviously applied to the first graphic shape made directly on the surface of the sheet or plate 2 and, subsequently after the execution of the PVD coating, the electrochemical decoration action was repeated, as mentioned, with the same masking or one ordered before the superimposition, centring the second decoration in the position of the first execution, so as to also obtain the similarly decorated/edged PVD coating.

The aesthetic effect obtained shows a different conformation of the graphic shape applied with the same masking. As already stated for the graphic shape 3, the application of the PVD coating softens the lines thereof, i.e., blurs the graphic shape, but the subsequent application of a further electrochemical action, i.e., on the metallic coating layer below the PVD micrometre covering it, highlights and marks the contours, triggering particular decorative effects due to the electrochemical action on the metallic material of the deposited PVD of oxides, carbides and metallic nitrides transforming them with greater visibility to the user. This gives the decoration obtained a new and different aesthetic effect. Furthermore, the decorative effect obtained is not constant but depends on the metallic material used for the PVD coating and on the electrochemical action and electrical current applied in the electrochemical action on the metallic PVD coating layer, creating new oxides, in addition to the oxides of the electrochemical action on the base metal, which generate shimmering and iridescent effects as well as more marked colours and combined with the decoration oxides previously obtained.

The graphic shape 12 can be further modified and rendered with a three-dimensional effect if the applications of the original electrochemical decoration of the graphic shape 3, directly on the metallic surface of the sheet or plate 2, and of the subsequent application of the decoration at such graphic shape on the applied PVD coating, are made to create a scenic depth effect of the decoration obtained as a figure obtained in 3D i.e., three-dimensional. This additional possibility of 3D graphic shape combined with the shimmering and iridescent effect indicated makes the decoration obtained even more refined and attractive to the user, whether it is applied to surfaces intended for decorative indoor furniture or if it is intended to be applied to surfaces for outdoor furniture.

Moreover, in the graphic shape 13 made with the electrochemical decoration directly on the PVD coating layer of the zone 14, without making a prior decoration on the surface of the sheet or plate 2 below, the decoration effect remains, i.e., it is shown with shimmering and iridescent contours, obtaining a new decorative effect, given the electrochemical decoration action which, performed directly on the PVD coating, is regardless of the base material on which the PVD coating is made. In fact, since making the PVD metallic coating on plastic, glass, ceramic and carbon fibre is known and the same coating is an electrical conductor, this form of decoration of the surface of the PVD coating alone can advantageously be decorated with electrochemical action, moreover including the shimmering and iridescent effects found on the PVD after the described electrochemical decoration action.

FIGS. 2-6 also show electrochemical decoration devices with the use of masking on both rigid surfaces, laid flat on the bottom of the device, and on flexible surfaces slid into the point of application of the electrochemical decoration action.

The simplest device 20 for flat materials of limited size, in FIG. 2, is formed by a tub 21 in electrically conductive material to which an end 22 of the electrical circuit is connected for activating the electrochemical action, generally the mass, and inside which is placed on the bottom 23 of the tank 21 a sheet 24 or even metallic mesh or flat conductor body such as a metallic fabric for its decoration. In FIG. 2, the treated surface 25 is covered by maskings 26 carried on the surface which is treated in various manners: for example as a thin material resistant to electrochemical action which is subsequently removed, or, also ink or paint resistant to electrochemical action which, after treatment, is removed by chemical action or simple washing with water. Moreover, said masking means are known in the art for the execution of decorations with electrochemical action on surfaces of electrically conductive materials.

The electrochemical action is activated by the passage at a short distance of an electrode 27, not in contact with the surface 25 being treated, immersed in an electrolytic solution bath, with level 28, which allows the activation of the electrochemical action on the treated surface leaving the parts covered by the masking 26 in their original state without the electrochemical oxidation action intervening on said surface. The electrode is connected to the other end 29, generally the phase, of the electrical circuit for activating the electrochemical action of the expected decoration.

The decoration action of FIG. 2 is also applied to metallic bases such as sheet metal 24, metallic mesh or fabric, obviously conductive, which have a metallic PVD coating, in fact the metallic material is in contact with the mass 22 of the electrical activation circuit and the treated surface 25, with the aforesaid PVD coating, faces the electrode 27 which, with the mediation of the electrochemical solution, allows the decoration to be applied even to the outer PVD coating of the treated surface 25. The mass electrical continuity is ensured by the close contact of the metallic PVD coating which is treated with the base surface of the metallic body on which the PVD coating is made.

Furthermore, in FIG. 3 a further sliding electrochemical oxidation device 30 of flexible metallic surfaces such as metallic tapes, mesh or fabrics 31, brought into sliding contact with a mass 32 placed in the bottom 33 of a tub 34 made of insulating material, is visible; the mass is connected to one end 35 of the electrical circuit for activating the electrochemical action; the flexible metallic surface is guided into immersion in the electrochemical solution with level 36 by means of rollers 37 sliding in contact with said mass 32, at an electrode 38 and spaced therefrom which is connected to the other end 39 of the electrical circuit for activating the electrochemical action. Maskings 41 are carried on a drum 40 which are placed next to the surface 42, in the treatment, of the metallic tape or mesh or fabric 31 interposed between the electrode 38 and such metallic tape, mesh or fabric; the maskings 41 advance with synchronous rotation R of the drum 40 with the advancement A of the metallic tape, mesh or fabric 31 being decorated. The electrochemical decoration action leaves the graphic shapes 44 on the surface 42 of such metallic tape, mesh or fabric being treated. Thus, the electrochemical decoration device described in FIG. 3 is adapted to decorate the PVD coatings applied to the surface 42 being treated since the electrochemical action manifests itself in the same manner described for the metallic tape, mesh or fabric 31 as described for the sheet metal 24 or metallic mesh or flat conductor body; moreover, the device of FIG. 3 is adapted to decorate in series a flexible tape body which is unwound and presents itself as it advances, in advancement A, at the decoration point between the electrode 38 and the mass 32. The maskings 41 remain applied to the drum 40, which consists of a screen-printed net to allow the passage of the electrochemical action between the electrode 38 and the mass 32 with the tape 31 resting thereon.

Figure 4:
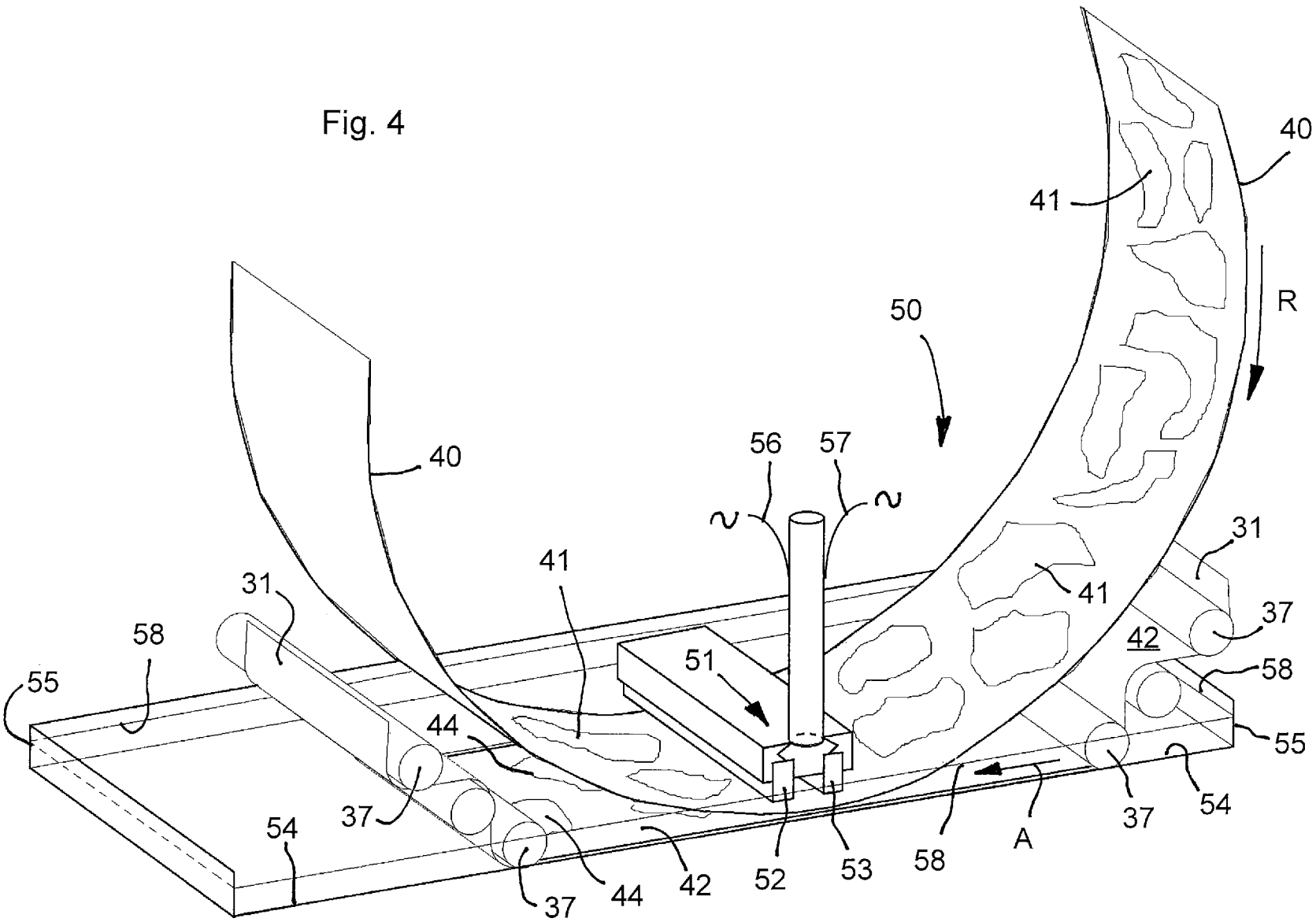
FIG. 4 depicts a schematic perspective and sectional view of a device for decorating flexible metallic or even non-metallic surfaces with electrochemical action; it can also be used on non-flexible surfaces, limited to the electrochemical action with two electrodes flanked on surfaces already treated with a PVD coating.

Moreover, in FIG. 4 a second sliding electrochemical oxidation device 50 of flexible surfaces such as metallic tapes, mesh or fabrics 31, similar to FIG. 3 above, is visible; such tapes are carried in the sliding at a double electrode 51, both for the mass 52 and for the phase 53, placed at a short distance from the bottom 54 of a tub 55 in insulating material; the mass and phase are connected to the ends 56 and 57 of the electrical circuit for activating the electrochemical action; the flexible metallic surface 42 is guided in the immersion in the electrochemical solution with level 58 by means of rollers 37 to slide on the bottom 54, at the double electrode 51 and spaced therefrom. As in the device 30, maskings 41 are carried on a drum 40 which are placed next to the surface 42, in the treatment, of the metallic tape or mesh or fabric 31 and interposed between the double electrode 51 and such metallic tape, mesh or fabric; the maskings 41 advance with synchronous rotation R of the drum 40 with the advancement A of the metallic tape, mesh or fabric 31 being decorated. The electrochemical decoration action leaves the graphic shapes 44 on the surface 42 of such metallic tape, mesh or fabric being treated, similar to the previous Figure. Thus, the electrochemical decoration device described in this Figure, as in FIG. 3, is adapted to decorate the PVD coatings applied to the surface 42 being treated since the electrochemical action manifests itself in the same manner described for the metallic tape, mesh or fabric 31 as that described for the sheet metal 24 or metallic mesh or flat conductor body. Moreover, the devices described are adapted to decorate in series a flexible tape body which is unwound and presents itself as it advances, in advancement A, at the decoration point between the electrode 38 and the mass 32 or below the double electrode 51.

Figure 5:
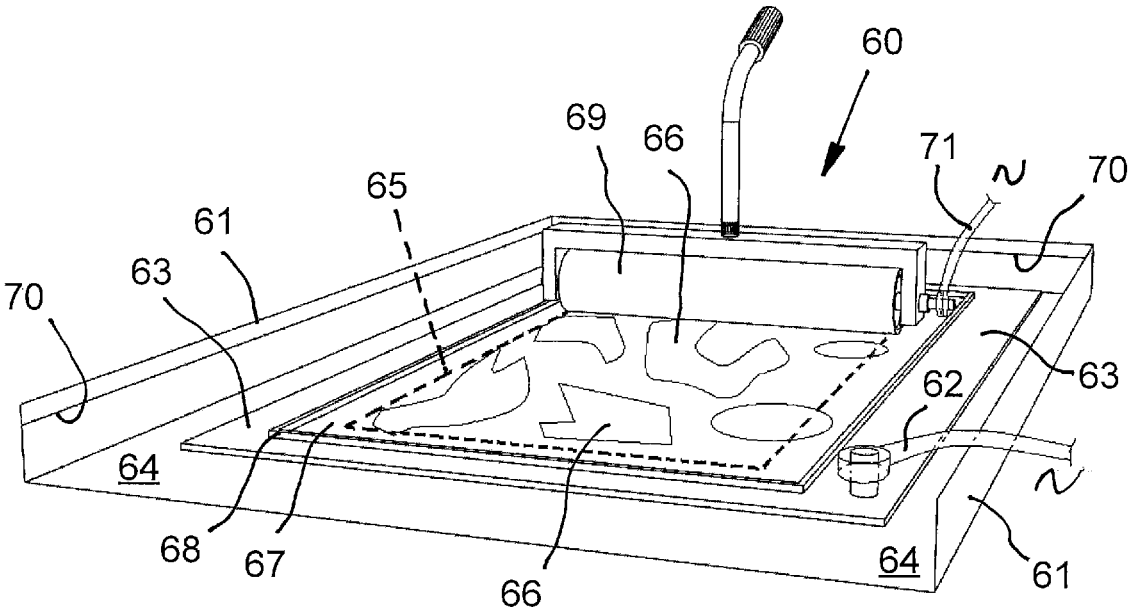
FIG. 5 depicts a perspective schematic view of a further device for decorating metallic surfaces with electrochemical action, of the rolling roller electrode type and operating similarly but faster than the device of FIG. 2.

A device 60 for planar materials of limited size, in FIG. 5, is formed by a tub 61 in non-conductive electrical material; one end 62 of the electrical circuit for activating the electrochemical action, generally the mass, is applied to a planar electrode 63, placed on the bottom 64 of said tub 61, a sheet 65 or also metallic mesh or flat conductor body such as a metallic fabric for its decoration. In FIG. 5, the treated surface is covered by maskings 66 carried on the surface which is treated, in this case by a screen printing net 67 resistant to electrochemical action which is subsequently removed with the maskings, stretched by a frame of the net 68 to cover the sheet 65 being treated.

The electrochemical action is activated by the passage at a short distance of a roller electrode 69, not in contact with the surface of the sheet 65 being treated, immersed in an electrolytic solution bath, with level 70, which allows the activation of the electrochemical action on the treated surface leaving the parts covered by the masking 66 in their original state without the electrochemical oxidation action intervening on said surface. The roller electrode 69 is connected to the other end 71, generally the phase, of the electrical circuit for activating the electrochemical action of the expected decoration. The electrode is placed to roll facing the surface being treated, generating the activation of the electrochemical action of the expected decoration even several times with alternating motion by the action of a robotic mechanical arm.

The decoration action of FIG. 5 is also applied to metallic bases such as sheet metal 65, metallic mesh or fabric, obviously conductive, which have a metallic PVD coating, in fact the metallic material is in contact with the mass 62 of the electrical activation circuit and the treated surface, with the aforesaid PVD coating, facing the roller electrode 69 which, with the mediation of the electrolytic solution and the minimum distance achieved by the screen printing net 67, allows the application of the decoration even to the outer PVD coating of the treated surface only. The mass electrical continuity is ensured by the close contact of the metallic PVD coating which is treated with the base surface of the metallic sheet 65 on which the PVD coating being treated is performed.

Figure 6:
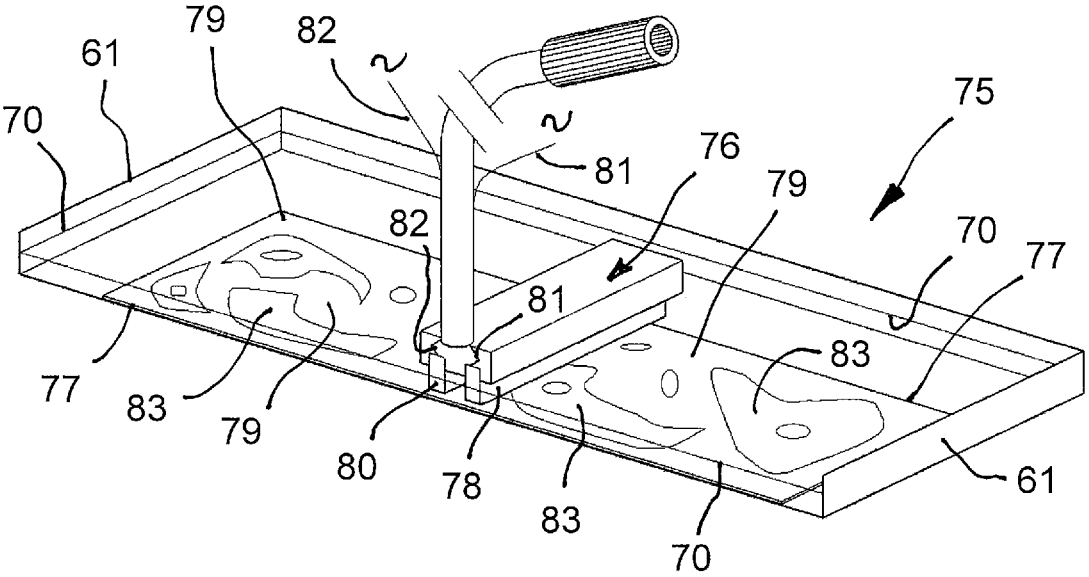
FIG. 6 depicts a schematic perspective view of a device similar to FIG. 2 for decorating surfaces, even non-metallic with electrochemical action, of the double electrode type, facing the surface with a masking for the electrochemical decoration treatment on the surface of the metallic PVD deposited on the continuous surface of the figure.

To complete a device 75 for flat materials of limited size, in FIG. 6, it is formed by a tub 61 in non-electrically conductive material; an electrical circuit for activating the electrochemical action applied to a double electrode 76, placed facing, but spaced from, a planar material 77; the double electrode has a first electrode 78 juxtaposed, but spaced linearly towards the surface 79 being treated, and a second electrode 80 aligned with the first; the two electrodes are connected individually to the ends, mass 81 and phase 82, of the electrical circuit for excitation of the electrochemical decoration action. In FIG. 6 the treated surface is covered by maskings 83 shown on the surface which is treated 79: such maskings are made of thin material resistant to electrochemical action which is subsequently removed, or, also ink or paint resistant to the electrochemical action which, after treatment, is removed by chemical action or simple washing with water.

The electrochemical action is activated by the passage at a short distance of the double electrode 76, not in contact with the surface 79 being treated, immersed in an electrolytic solution bath, with level 70, which allows the activation of the electrochemical action on the treated surface leaving the parts covered by the masking 83 in their original state without the electrochemical oxidation action intervening on said surface. The double electrode 76 is placed to slide facing the surface being treated, generating the activation of the electrochemical action of the expected decoration even several times with alternating motion by the action of a robotic mechanical arm.

The decorative action of FIG. 6 is applied in addition to metallic surfaces such as the planar conductive material 77, or on planar non-conductive material 77, which however carries a metallic PVD coating. In fact, the electrical activation action of the electrochemical decoration action occurs between the mass 81, and the related first electrode 78, towards the surface 79 being treated and the second electrode, i.e., phase 82, with the closure of the electrical activation circuit through the treated surface, which can be limited to the aforesaid PVD coating only. The mass electrical continuity is ensured by the same metallic PVD coating which is treated on the surface 79 of the planar material 77 on which the PVD coating being treated is performed.

The device of FIG. 4 can also electrochemically decorate flexible and continuous surfaces of non-metallic base materials, but coated with a metallic PVD deposit. In fact, the presence of an electrochemical surface oxidation action manifests itself through the double electrode 51 because the electrochemical action makes use of the electrical continuity which the flexible and continuous surface PVD coating thereof has, allowing the surface decoration with electrochemical oxidation of the PVD coating layer only.

Similarly to what is stated for continuous surfaces in non-conductive base material such as plastic, glass, crystal, ceramic and the like, with a double electrode 51, in FIG. 6, with the immersion of the non-electrically conductive base material in the tank 61, of the Figure, the electrochemical decoration of the PVD coating only applied to such surfaces in non-electrically conductive base material, even rigid, is performed.

The use of the method for decorating metallic or non-metallic surfaces treated with PVD according to the invention occurs as already described above and in which the execution variants of the decoration with electrochemical action are shown below.

With the decoration process with electrochemical oxidation, a conversion reaction is carried out of the surface part, less than 100 nanometres of the natural oxide of the metal or of the surface part of the PVD coating deposited on the metallic or non-metallic material to be decorated, always within 100 nanometres. This decoration creates a compact and thin oxide layer, without any porosity, conditioning the natural metal oxide or the deposited PVD coating. In the case of prior deposit of the decorative PVD, the layer deposited by the PVD about 1000 nanometres thick, goes to superimpose the natural oxide which, as indicated, is of the order of 100 nanometres.

As a result of the combination of the decorative treatments mentioned above, interesting chromatic effects are formed as a result of the non-homogeneous combination which generates the treatment on the surface part of the PVD deposit, producing various interference colouring.

Moreover, even a treatment with an aesthetic colouring purpose similar to the PVD deposit, such as the treatment of galvanic chromium coating with thin thickness called "electrocolouration", allows to make, with the same electrochemical process, decorations on the surface of a stainless steel plate previously treated with electrocolouration; the decorative effect almost completely modifies the thickness of the thin chromium oxide coating created, and gives rise to decorative forms which are still appreciable even if less incisive than the decorations obtained on PVD deposit and without obtaining iridescent effects.

Other differences that make PVD preferable to the "electrocolouration" treatment are as follows. The PVD deposit, with respect to the aforesaid "electrocolouration" treatment, occurs at room temperature without the need for long stops in galvanic baths at a temperature of 80-90°, which are necessary for the deposit of chromium to increase its oxide, and in the complete absence of any dangerous chemical emission for the environment. The electrocolouration treatment does not increase the technical features of the metallic support which are obtainable, however, with the PVD deposit.

The application of the electrochemical oxidation process, by means of the devices described above, is regularly carried out at low voltage, from 6 to 14 volts in alternating current, AC, and current of 100 Ampere per square surface metre, at a speed of 20 seconds per square metre. Depending on the desired colour intensity, repeated steps can be carried out to obtain different colour intensities (from a minimum of 4 to 8 steps). Therefore, with the electrochemical decoration speed of a metallic surface or a PVD layer applied to a surface to be decorated, the treatment time with the electrical activation data shown above is 2 minutes for each square surface metre treated.

Following the methods of execution of the electrochemical decoration described, and claimed in this invention, the application of the decoration method is very fast with respect to the usual galvanic, electroerosion or electrodeposition treatments, as well as the time to obtain a minimum deposit of a PVD layer, since the process described in the method of this invention does not perform any deposit and does not perform any erosion of metals, but only a conditioning of the oxide present in the treated outer surface which is less than 100 nanometres.

A surface investigation of a surface treated with the described method is possible with classical chemical analyses, as well as with investigation with the Electronic Microscope and also specifically to distinguish the oxide layers from each other by Reflection Spectroscopy (for example RAMAN spectroscopy).

In the art it is known to use a screen printing net, as mentioned in FIG. 6, which distances the single electrode 27 or 38 or even the double electrode 51 or 76 from the thickness of such net. In the art it is known that the electrochemical decoration action occurs at the minimum distance for an effective activation of the electrochemical decoration oxidation. In fact, a screen printing net is resistant to the electrochemical action applied, generally weak as weak aqueous bases are used in the electrolytic solution, and allows an electrode both in the form depicted, simple 27 and 38 or double 51 or 76, to remain close to the surface under decoration treatment, the net being able to carry maskings as in the case of the drum 40 or net 67, or even act as a simple spacer for a doctor blade-shaped electrode, 27 or 76, or roller 69, thus also a PVD coating can be treated with the electrochemical decoration described. In the case of double electrode 51 or 76, the application can also be carried out on base materials of the non-metallic or non-conductive PVD coating, in fact it is the PVD coating itself which acts as an electric conductor between the two electrodes of the double electrode 51 or 76 to close the electrochemical action on such PVD coating, this being able to occur on continuous non-electrically conductive surfaces, while on non-continuous surfaces such as non-conductive fabrics or material mesh, the continuity of the PVD coating is lacking, i.e., it does not allow certain electrical conduction.

Furthermore, a single electrode 27 or 38 or double electrode 51 or 76 can operate if a buffer is placed between the electrode and the metallic treatment surface or the PVD coating which, if soaked with electrochemical solution, in addition to performing the function of a spacer between the surface and the electrode, bathes both the electrode and the surface being treated, making the electrochemical action possible.

The advantages in using a method for decorating metallic or non-metallic surfaces treated with PVD as described can be summarized as follows.

With the application of the PVD coating to the conductive surfaces already decorated with selective electrochemical decoration, even by masking the treated surface, an improvement in the performance of resistance to external agents of the decorated surface is achieved, in fact the protection obtained by the PVD coating makes the decorated surface more unattackable with respect to the original surface, however, the creations of known PVD coatings do not have decorations of any kind, thus even one PVD decoration is new and more decorative if it is placed to cover an electrochemical decoration of an electrically conductive surface.

Moreover, the creation of a PVD coating on a conductive surface, even if not continuous or even non-conductive, but continuous, allows to further decorate the metallic PVD coating, which in itself is electrically conductive, obtaining new graphic shapes of decoration in relation to the metallic material deposited with the PVD and the particular regulation of the electrical parameters of the electrochemical decoration action. Thereby, the graphic shape of the decoration obtained on the PVD coating has shimmering and iridescent characters which are not possible with a simple electrochemical decoration of metals, while the use of specific mixtures of metals or metal oxides of the PVD coating and the electrical parameters of the decoration allow it.

A further and not previously known advantage is obtained if a graphic shape made on an electrically conductive surface, for example the graphic shape 3 of the example of FIG. 1, is superimposed on an additional electrochemical decoration on the PVD coating applied to such surface being treated, the surface 11 of the example, obtaining a graphic shape, with reference 12, which summarizes in itself both the decorative transparency of the PVD coating, applied to the original graphic shape made on the electrically conductive surface, and the further new and striking shimmering and iridescent decoration of the application of an electrochemical decoration made on the PVD coating. This embodiment also offers the further advantage of allowing decoration with shapes which show three-dimensionality even if they are made on the coating or thereunder in PVD as described i.e., in a micrometric thickness or less.

Obviously, a person skilled in the art, in order to satisfy specific and contingent requirements, may make numerous modifications to a decorating method of metallic or non-metallic surfaces treated with PVD, as previously described, all nevertheless falling within the scope of protection of the present invention as defined by the following claims. In particular, although less conveniently, it is known that in the decorated surfaces a decoration with a three-dimensional effect is obtainable with the execution of an electrochemical decoration with different maskings but made for the purpose and with repeated applications on the same surface point in the decoration treatment, this effect can also be used on the PVD coating of the decorated surfaces object of the present disclosure.

The invention claimed is:

1. A material comprising a metallic surface already treated with PVD (Physical Vapor Deposition), wherein the PVD has added a metallic oxide layer to the metallic surface, wherein the metallic oxide layer has been further treated with an additional method, the additional method comprising:

orienting a first electrode and a second electrode to face the metallic oxide layer, wherein the first electrode contacts the metallic oxide layer, and the second electrode is in electric communication with the metallic oxide layer via a conductive chemical solution; and a masking element is interposed between the second electrode and the metallic oxide layer;

running an electric current through a circuit, wherein the first electrode and second electrode are connected to the circuit, thereby electrochemically oxidizing the metallic oxide layer;

wherein the electrochemical oxidation does not remove metallic material from the metallic oxide layer; and the electrochemical oxidation aesthetically modifies the oxides on the metallic oxide layer, thereby creating a marked decorative appearance in a manner determined by the masking element.

2. The material according to claim 1, wherein the metallic surface has shimmering and iridescent colours, wherein said shimmering and iridescent colours were obtained from said additional method.

3. The material, according to claim 1, wherein a surface investigation of the metallic oxide layer treated with the additional method can only be distinguished from a surface not treated with the additional method by reflection spectroscopy.

* * * * *